US005443273A

United States Patent [19]

Lovorn

[11] Patent Number: 5,443,273

[45] Date of Patent: Aug. 22, 1995

[54] METHOD FOR ATTACHING FLETCH ON ARROW AND DEVICE FOR PRACTICING THE SAME

[76] Inventor: Joseph W. Lovorn, 302 Plantation Rd., Dothan, Ala. 36303

[21] Appl. No.: 144,272

[22] Filed: Oct. 29, 1993

[51] Int. Cl.[6] ..... F42B 6/06

[52] U.S. Cl. ..... 273/423; 269/38

[58] Field of Search ..... 273/416, 420, 423; 269/38

[56] References Cited

U.S. PATENT DOCUMENTS

| | | | |
|---|---|---|---|
| 1,789,575 | 1/1931 | Allen | 273/420 |
| 1,794,051 | 2/1931 | Allen | 273/420 |
| 2,782,036 | 2/1957 | Folberth et al. | 273/423 |
| 5,096,211 | 3/1992 | Morais | 273/420 |

*Primary Examiner*—William H. Grieb

[57] ABSTRACT

A product and method directed to attaching a fletch to an arrow shaft providing for proper alignment and ease of replacement is disclosed. The invention utilizes a fletch with or without glue held within a series of aligned holes in a hollow arrow shaft. The holes would serve to receive anchor stems which would be a part of the fletch base. In order to provide for a proper alignment and fit, the preferred embodiment envisions preparing the shaft with a jig, held in place by a removal hole in the shaft receiving a socket head cap screw which fits through and within the jig having a portion thereof which fits within the removal hole.

The jig is a housing defining a series of parallel holes which serve as guides for drilling holes in the shaft to receive the fletch anchors. The fletch anchors are designed to fit within the stem holes and hold the fletch in place with or without glue.

13 Claims, 4 Drawing Sheets

METHOD FOR ATTACHING FLETCH ON ARROW AND DEVICE FOR PRACTICING THE SAME

BACKGROUND OF THE INVENTION

This invention relates broadly to the art of fletch design for arrows.

More particularly, the invention relates to an improved method of attaching a fletch to an arrow and so that the light stabilizing means may be easily attached, interchanged or replaced.

U.S. Pat. No. 5,096,211 Morais shows an example of historical mechanisms for affixing fletches to arrow heads utilizing the modification of the arrow or dart stand.

U.S. Pat. No. 1,789,575 Allen shows the utilization of a slotted arrow stand for insertion of a fletch held in place by glue into a tubular metal shaft. This allows for easy replacement of the fletch. Similarly, U.S. Pat. No. 1,794,051 shows the same type of mechanism also utilizing glue and also utilizing a mechanism for replacing the fletch.

Part of the problem with the Allen I and Allen II patents is that both of them require glue and both of them require a lengthy modification of the arrow and are complicated in the mechanism for replacing the fletches. And in the light weight arrows used today, the slits may weaken the shaft beyond use.

GENERAL DISCUSSION OF THE INVENTION

The invention in the preferred embodiment envisions fletches having bases defining male insertion means. The arrow shaft may be modified to have female receiving means for cooperating with the male insertion means so that the fletches are attached to the shaft by way of these insertion means. The insertion means have a cone shaped tip. This tip flexes to fit within the shaft and then are difficult to remove without tearing off the cone.

A jig is used as a guide for a drill to provide a series of aligned holes in a hollow arrow shaft. The holes serve to receive anchor stems which would be a part of the fletch base. In order to provide for a proper alignment and fit, the preferred embodiment envisions preparing the shaft with a jig. A removal hole which can be used for subsequent removal of the anchor stems is used to hold the jig in place. This hole, referred to as the removal hole, is used for receiving a socket head cap screw which fits through and within the jig. The socket head cap screw has a portion which fits within the removal hole in the shaft to hold the Jig in place while holes are drilled into the shaft. Another part of the socket head cap screw has male threads which cooperate with female thread in the jig to hold the cap screw to the jig.

The jig is a housing defining a series of parallel holes which serve as guides for drilling holes in the shaft to receive the fletch anchors. The fletch anchors are designed to fit within the stem holes and hold the fletch in place with or without glue. These parallel holes may be replaced with helical spaced holes as described in more detail below.

In order to fit the jig in place, the jig is fitted over the shaft a predefined distance from the nock. The jig is fixed in place by drilling a hole through the shaft through the jig removal hole, and placing the socket head cap screw through the hole in the shaft to hold the jig in place. As mentioned above, helical or parallel holes are envisioned in alternate embodiments.

It is therefore an object of this invention to provide for improved fletches anchored by way of anchor stems to an arrow.

It is a further object of the invention to provide for easily replaceable fletches.

It is a further object of the invention to provide a product for modifying, preferably hollow, arrows to receive the improved and replaceable fletches.

It is a further object of the invention to disclose a method for modifying arrow shafts to receive a fletch in a helical or parallel alignment.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

1.

DETAILED DISCUSSION OF THE PREFERRED EMBODIMENT(S)

Figure 1:
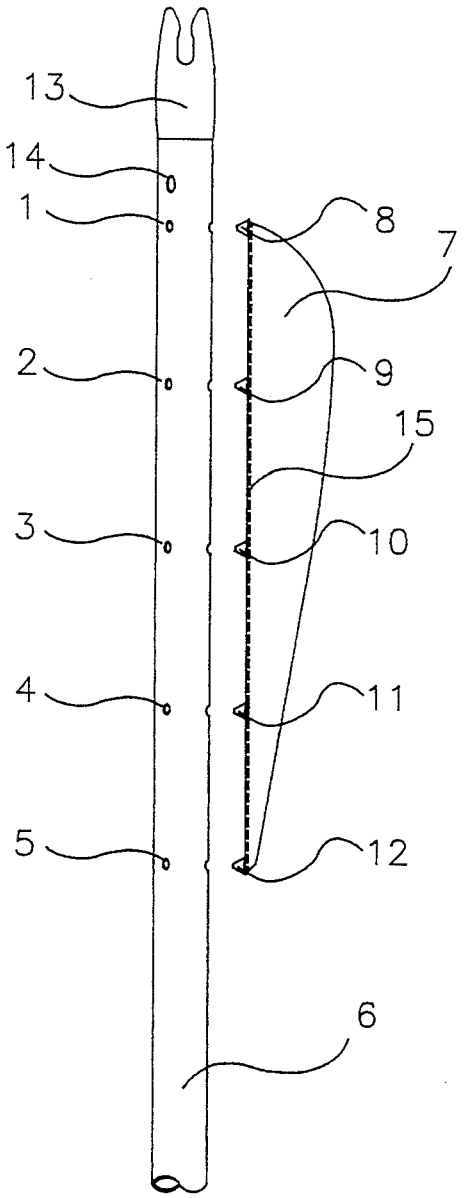
FIG. 1 shows a portion of an arrow shaft where the invention is inserted
2.

As can best be seen, by reference to FIG. 1, the invention comprises a series of holes 1 through 5 drilled in the shaft 6 of an arrow. These holes receive a series of anchor stems 8 through 12.

Anchor stems 8 through 12 are aligned along the base of the fletch 7. Holes 1 through 5 are aligned in a parallel or helical arrangement on the arrow shaft 6 so that the distance between the holes 1 through 5 is the same as the distance between the anchor stems 8–12.

Figure 13:
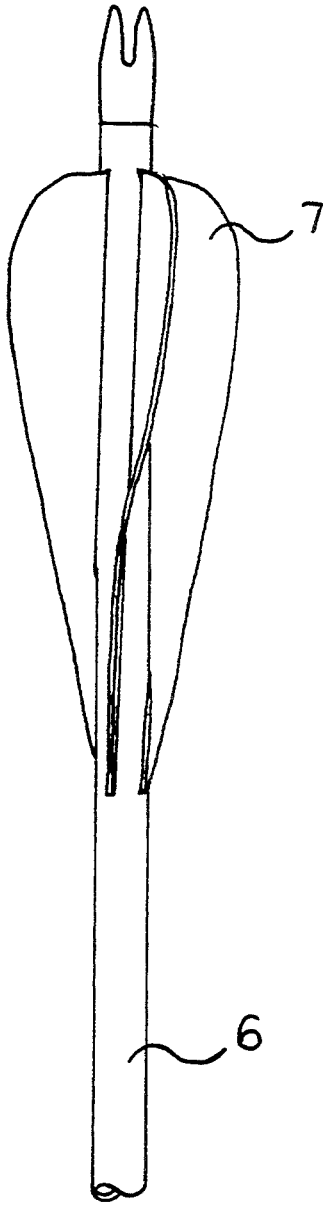
FIG. 13 shows a plan view of an arrow shaft having helical arranged fletches.
14.
Figure 14:
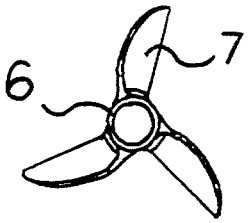
FIG. 14 shows a plan view from the nock of an arrow shaft having helical arranged fletches.
15.

In the preferred embodiment, when the fletch anchors 8–12 are inserted, the fletch 7 is aligned parallel as shown in FIG. 1. Holes 1 through 5 could be similarly located to provide either a left or right helical curve to the fletch 7 as shown in FIGS. 13 and 14. As an example, this spiral may have a rate of twist of spiral of 1 revolution in 45 inches.

Figure 3:
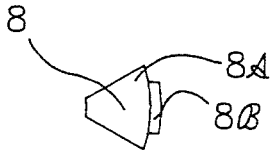
FIG. 3 is a detail of one embodiment of a side view of an anchor stem.
4.
Figure 4:
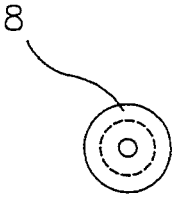
FIG. 4 is a cross sectional view of the stem shown in FIG. 3.
5.
Figure 5:
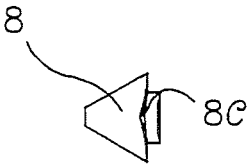
FIG. 5 is the anchor stem of FIG. 3 rotated 90 degrees.
6.
Figure 7:
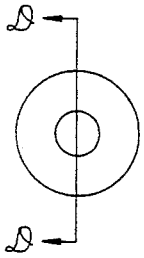
FIG. 7 shows a left end view of FIG. 6.
8.

The anchor stems 3–12 have two parts. The fletch 7 is held by an anchor base **8*b* which bases 8*b* are attached or made an integral part of the fletch base 15. The second part of the stems 8–12 is a widened cone 8*a* having the broader portion of the cone 8*a* attached to the anchor base 8*b*. The cone 8*a* is envisioned as being made out of an elastic material, such as plastic, so that when the cone 8*a* is inserted into one of the stem holes 1 through 5, the cone 8*a* is slightly wider than the hole 1 through 5 and therefore has to flex to fit within the holes 1–5. Then it serves to hold the fletch 7 in place and aligned along the arrow shaft 6. As can be seen by reference to FIG. 3 and FIG. 5, the cone 8*a* angles downward on either side. The apex 8*c* of this angle is shown in FIG. 5 and serves to allow the cone 8*a*** to flex adequately.

Figure 2:
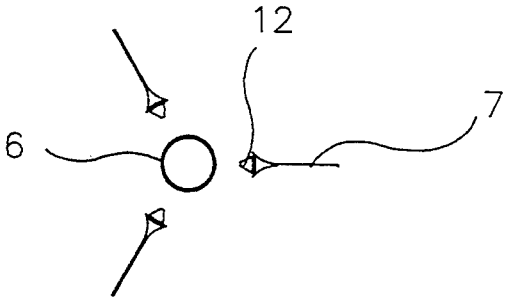
FIG. 2 shows an exploded cross-section of the arrow shaft of FIG. 1 showing three fletches separated by 120 degrees to be inserted into the arrow shaft.
3.

As can best be seen by reference to FIG. 2 in the preferred embodiment, there are three separate sets of stem holes 1 through 5 allowing for three fletches 7 to be attached. The cross-sectional view shown in FIG. 2 does not show the holes, but does show how the stems fitting within the holes may be aligned so that there are three fletches 7 equal distance from one another aligned along the shaft 6 to provide proper flight.

In addition to the holes 1–5, there is an enlarged stem removal hole 14 which serves two purposes in the preferred embodiment. One purpose is to hold the jig 16 (discussed in more detail below) in place. The second purpose is that, in the event fletches 7 need to be replaced or interchanged, the anchor stems 8 may be cut lose by running a knife blade along the arrow shaft between the fletch 7 and the shaft 6. Similarly, they may be pulled off through use or through tearing. The anchor stems 8 may then be removed through the hole 14.

Figure 6:
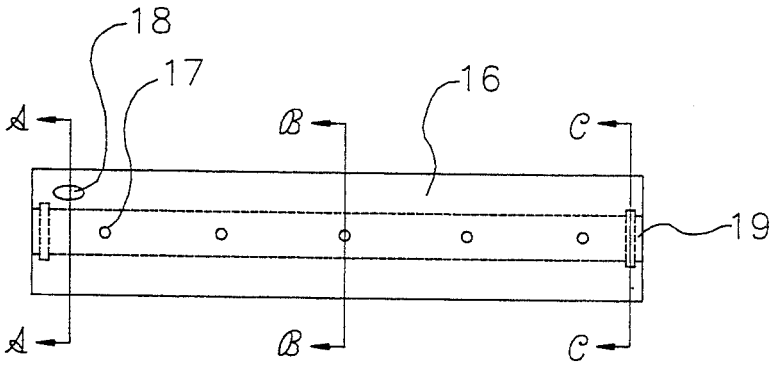
FIG. 6 shows a plan view of the jig utilized to drill holes for placement of arrow fletches utilized in FIG. 1.
7.

As can best be seen by reference to FIG. 6, the jig 16 defines a series of holes 17 which correspond to the parallel holes 1 through 5 which are to be put into an arrow shaft 6. Although the preferred embodiment shows these holes 1–5 in a straight or parallel alignment with the arrow shaft 6, they could easily be in a left or right spiral or helical arrangement along the arrow shaft 6 as shown in FIGS. 13 and 14.

In addition, the Jig 16 defines an enlarged hole 18 which corresponds to the stem removal hole 14.

Figure 9:
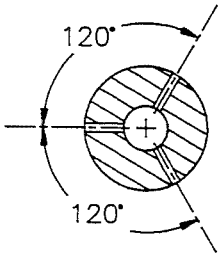
FIG. 9 shows a cross-section through the BB axis of FIG. 6.
10.

As shown in FIG. 9, the parallel rows of holes 17 would be found at locations separated by 120 degrees along jig 16. In this way, after drilling the shaft 6 the fletches 7 would be evenly spaced.

The Jig housing 16 defines a central shaft 19 which allows the housing 16 to be inserted over the arrow shaft 6.

Figure 8:
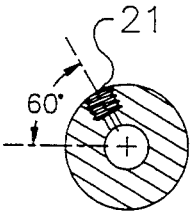
FIG. 8 shows a cross-section through the AA axis of FIG. 6.
9.
Figure 11:
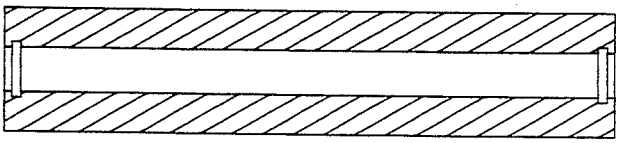
FIG. 11 shows a cross-section of the jig of FIG. 6 shown through the DD axis in FIG. 7.
12.
Figure 12:
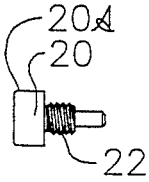
FIG. 12 shows a detail of the socket head cap screw utilized with the jig and cooperating with the threads shown in FIG. 8.
13.
Figure 10:
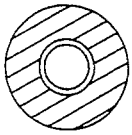
FIG. 10 shows a cross-section through the CC axis of FIG. 6 detailing one of the two grooves for O-Rings which hold the jig firmly in contact with the arrow shaft, while preventing the Jig from scratching the finish on the arrow shaft.
11.

When the jig 16 is fitted onto the shaft 6 at a predetermined location where the fletches 7 are to be located, a single hole is drilled through alignment pin hole 18 and a socket head cap screw 20 is inserted within that hole 18 as shown in FIG. 12. Hole 18 defines a series of threads 21 which cooperate with threads 22 on the socket head cap screw 20 to hold the jig 16 in place as shown in FIG. 8.

The end **20(*a*) of the socket head cap screw 20 remains outside of the housing 16 and hole 18 to simplify removal or placement of the socket head cap screw 20**.

This need only be hand tightened based on the temporary nature of the placement.

At this point in time, the series of holes 1 through 5 separated by 120 degrees may be drilled through the holes 17 provided in housing 16 for that purpose.

In this way, an unmodified shaft 6 may be made to utilize the invention disclosed in this application.

Either before or after the fletch 7 is put in place a glue line may be placed either within the holes 1 through 5 or along the base 15 of the fletch 7 if desired by the user.

In the preferred embodiment this is unnecessary since the anchor stems 8 are sufficient to hold the fletch 7 in place.

Figure 15:
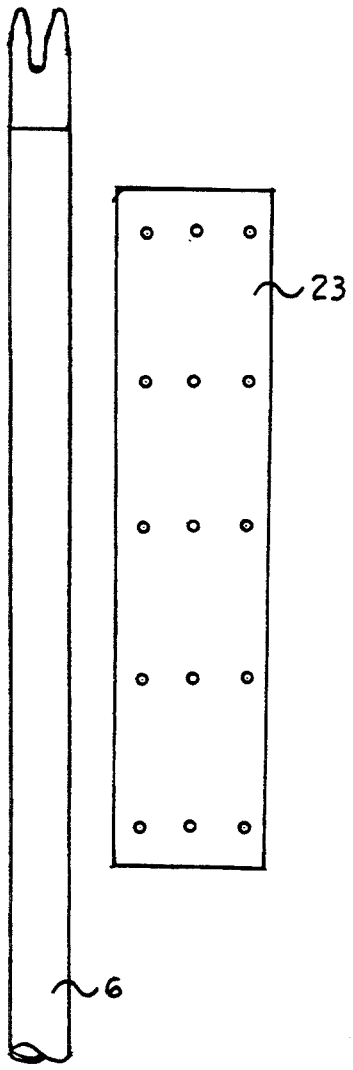
FIGS. 15–17 show how the Jig disclosed in FIG. 6 may be replaced with a tape.
Figure 16:
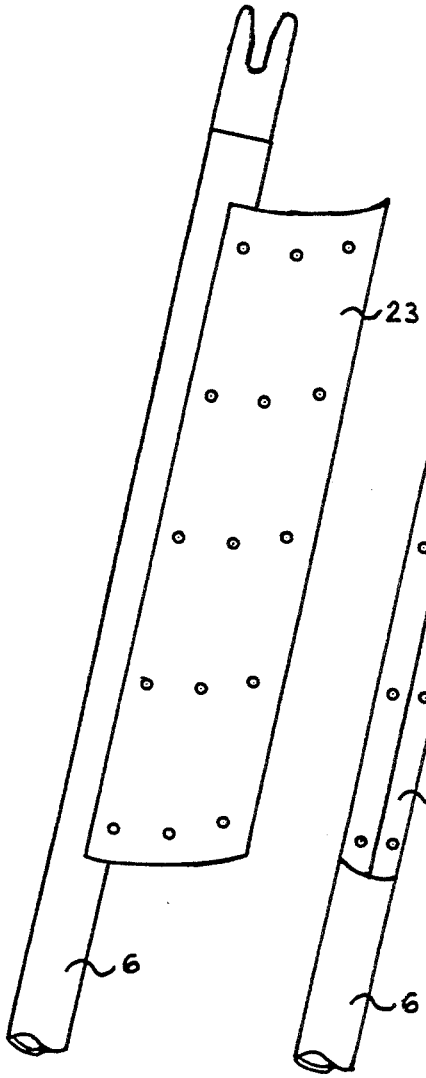
Figure 17:
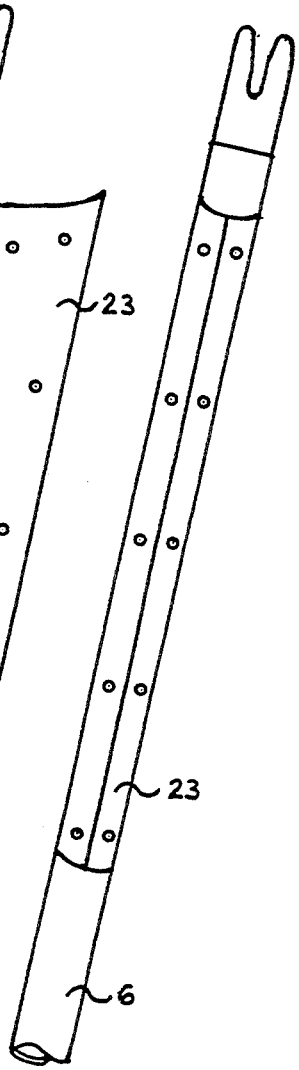

Since the method of fixing the jig 16 in place may be varied, it can be seen that the jig 16 could be replaced with a wrap around tape 23 defining the same circumference as the arrow shaft 6 as shown in FIGS. 15–17. The location of parallel or helical aligned holes could be defined by such a tape 23. In this way, the tape 23, corresponding in circumference to the arrow shaft 6 could be wrapped around the arrow shaft 6. At this point in time, the holes could be drilled.

For convenience of use, the markings for holes could have different shapes or colors for each type of hole (e.g. the parallel holes 1–5 as shown in FIG. 1 could be blue circles; right helical holes could be green squares and left spiralling helical holes could be yellow triangles). Similarly this tape 23 could be replaced by painting similar information directly onto the shaft 6.

The main problem with tape 23 or painting compared a thicker jig 16 is that it would be more difficult to drill the holes 1–5 without a thicker jig 16. The benefit is that strips of these tapes 23 could be sold along with the fletches 7 to be used. Also these tapes 23 could be made large enough to fit around a standard diameter pipe (e.g. $\frac{1}{4}$ inch pvc pipe) to allow the user to make a jig 16. Another benefit of such tapes 23 is that they could be left in place on the arrow shaft 6 after the holes 1–5 are drilled.

These tapes 23 could have glued lines on either side so as to provide the glue line to help hold the fletches 7 in place.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

I claim:

1. An improved fletch mounting comprising (a) an arrow shaft having a front and a rear and a length running between the front and the rear and wherein said arrow shaft defines at least one mounting means for mounting a fletch;

(b) at least one fletch having a base, said base having attached at least one attachment means for attachment to the mounting means; and wherein the mounting means comprises a plurality of holes defined by the arrow shaft located at the rear of the arrow shaft and wherein the attachment means is further defined as a plurality of anchor stems which may fit within the plurality of holes; and wherein the anchor stems are further defined as having an anchor pillar attached to the fletch base,

2. The mounting of claim 1 wherein the plurality of holes are further defined as running in a helical fashion along the length of the arrow at the rear of the arrow shaft.

3. The mounting of claim 1 wherein the plurality of holes run in a parallel line along the length of the arrow shaft.

4. The mounting of claim 1 wherein the anchor stems are further defined as having a tightening means for holding the fletch base substantially tightly to the arrow shaft,

5. The mounting of claim 4 wherein the tightening means is further defined by having the pillar further defined as having a width and wherein the width is further defined as being substantially the same width as the holes so that the movement of the fletch is restricted,

6. The mounting of claim 4 wherein the tightening means is further defined by having the pillar further defined as having a length and wherein the length of the pillar is substantially the same length as the thickness of the stem,

7. The mounting of claim 4 wherein the tightening means is further defined by having a cone mounted on the end of the pillar.

8. The mounting of claim 7 wherein the cone is further defined as a flexible cone.

9. The mounting of claim 7 wherein the location of the cone on the pillar is further defined as being at a location on the pillar at substantially the same distance from the base as the thickness of the stem,

10. The mounting of claim 7 further comprising a removal hole defined by the shaft which is of substantially greater diameter than the width of the cones.

11. An improved fletch mounting comprising:

(a) an arrow shaft having a front and a rear and a length running between the front and the rear and wherein said arrow shaft defines a plurality of parallel rows of holes;

(b) at least one fletch having a base, said base having attached a plurality of anchor stems spaces to correspond in location with the plurality of parallel holes and wherein the anchor stems comprise an anchor pillar attached to the fletch base and a cone mounted on the end of the pillar.

12. The mounting of claim 11 wherein the cone is further defined as a flexible cone.

13. The mounting of claim 11 wherein the arrow shaft has a wall thickness between an outer surface of the arrow shaft and the inner surface of the arrow shaft and wherein the location of the cone on the pillar is further defined as being at a location on the pillar at substantially the same distance from the base as the wall thickness of the arrow shaft.

* * * * *